US009023078B2

(12) United States Patent
Dehors

(10) Patent No.: US 9,023,078 B2
(45) Date of Patent: May 5, 2015

(54) SOFT TISSUE TECH INSTRUMENT

(76) Inventor: Jonathan Edward Dehors, Apex, NC (US)

( * ) Notice: Subject to any disclaimer, the term of this patent is extended or adjusted under 35 U.S.C. 154(b) by 609 days.

(21) Appl. No.: 13/328,450

(22) Filed: Dec. 16, 2011

(65) Prior Publication Data

US 2012/0158040 A1 Jun. 21, 2012

Related U.S. Application Data

(60) Provisional application No. 61/425,248, filed on Dec. 21, 2010.

(51) Int. Cl.
*A61H 7/00* (2006.01)

(52) U.S. Cl.
CPC ..... *A61H 7/003* (2013.01)

(58) Field of Classification Search
CPC ..... A61H 7/001; A61H 7/003; A61H 7/007; A61H 39/04
USPC ..... 601/1, 84, 134–136; D24/214, 215; 606/201
See application file for complete search history.

(56) References Cited

U.S. PATENT DOCUMENTS

| | | | | |
|---|---|---|---|---|
| 5,441,478 | A | 8/1995 | Graston | |
| 6,077,239 | A | 6/2000 | Lin | |
| 6,887,211 | B1 * | 5/2005 | Sevier et al. | 601/135 |
| D524,445 | S | 7/2006 | Liang | |
| D530,429 | S | 10/2006 | Sevier et al. | |
| 7,431,706 | B2 | 10/2008 | Louis | |
| D624,193 | S | 9/2010 | Katzenberger | |
| D634,022 | S | 3/2011 | Scappaticci | |
| 2007/0135741 | A1 * | 6/2007 | Gueret | 601/119 |
| 2009/0177210 | A1 * | 7/2009 | Durso | 606/133 |

OTHER PUBLICATIONS

Wikipedia, Nose Cone Design, 2011.
Wikipedia, Spherically Blunted Tangent Ogive Geometry.

* cited by examiner

*Primary Examiner* — Kathleen Holwerda
*Assistant Examiner* — Sarah W Aleman
(74) *Attorney, Agent, or Firm* — Bernhard P. Molldrem, Jr.

(57) ABSTRACT

A pair of soft tissue instruments which provide a combination edge profile allowing a single tool to break up fibrous adhesions and massage damaged tissues in order to restore healthy function to muscles, tendons, ligaments and nerves that have been affected by inflammation, injuries or various traumas. The combination edge profile is formed by a double wide radius following the full thickness of the tool similarly as a spherically blunted tangent ogive, including a nose radius covering around 90 degrees of the curved edge; the double specific radius sharpness angle varying from 1 degree near the full tool thickness of the instrument up to around 50 degrees as an average, but reaching around 90 degrees just when it reaches the much smaller tip edge radius.

20 Claims, 2 Drawing Sheets

SOFT TISSUE TECH INSTRUMENT

REFERENCE TO PROVISIONAL

This application is a continuation of the provisional patent, application No. 61/425,248, filed Dec. 21, 2010 entitled Soft Tissue Tech abbreviated ST2.

BACKGROUND OF INVENTION

The majority of people suffer from neuro-musculo-skeletal pain sometime throughout their life. This pain is caused by either neurological compromise or by the soft tissue structures, such as the ligaments, tendons, muscles or fascia. Inflammation causes scar tissue, also known as fibrotic adhesions or fibrosis, to build up in and on the soft tissue structures mentioned above. Things like over training, not stretching before and after a workout, experiencing trauma to the soft tissue, or having a repetitive strain injury can cause fibrosis to line these structures and cause chronic pain.

Fascia lines every muscle in the body. This fascia is supposed to be mobile and not adhere to the muscle layer below it. After any of the above actions that cause inflammation to occur, the inflammatory process is activated. When this process is resolved, there are fibrotic adhesions left behind that adhere the fascia to the underlying muscle and tendon. This adherence causes decreased range of motion for the muscle and joint that it moves. This same concept of inflammation and fibrosis happens to ligaments.

Ligaments have a certain amount of plasticity which allows them to return to their normal length after they have been stretched when a joint reaches its end range or just beyond. When there are fibrotic adhesions on a ligament it loses its resilience and upon stretching the ligament doesn't return to its original length. This laxity in the ligament causes joint hypermobility, which in turn causes the muscles to spasm and secure the hypermobile joint. The increased or decreased motion in the joint causes degenerative changes to the cartilage. Also, the non resilient ligament may be easily torn.

Cartilage in the joints do not receive nutrients from blood like almost every other structure in the body. Joints receive nutrients from diffusion. Motion is needed for this process to be effective. So, if a joint is restricted, the joint degenerates. The same is true for too much motion, the cartilage breaks down quicker than it is repaired due to too much movement. Basically, the nerves, muscles, tendons and ligaments have to function properly in order for the joints to function properly.

In recent years, there have been many designs to treat soft tissue dysfunction. Many of these instruments have shapes to match body contours. Some designs have multiple tools to treat different areas. The majority of these tools are finished to a shiny/slippery surface. In addition to a slippery surface, the treatment edges are either a single bevel or a double bevel.

The following U.S. patents related to those designs are:

| | |
|---|---|
| John G. Louis. | No. 7,431,706 |
| Jung-Miin Lin. | No. 6,077,239 |
| David A. Graston. | No. 5,441,478 |
| Roman A. Wolocko. | No. 4,483,328 |
| Mark J. Scappaticci. | No. D634,022 |
| Ya-Ting Liang. | No. D524.445 |

Most treatment tools today have a single or double bevel edge with a taper or conical section which does not permit either double functions or double direction of treatment with the tool; furthermore, their straight taper or bevel edge sharpness is not conducive to a progressive breakdown of fibrous adhesions, scar tissue and trigger points since the only constant parameter of current instruments is the edge shape and its tip radius edge of 50 degrees or more, the practitioner is obliged to constantly vary the tool's angle position in relation of the tissue surface to be treated; therefore, the treatment success is highly related to the intuitive or learned practitioner skill.

SUMMARY OF INVENTION

The invention, referring to the soft tissue tech instrument, also known as $ST^2$, is an instrument designed to break up fibrous adhesions, trigger points and scar tissue in any of the soft tissues mentioned above; the double radius edge is designed to allow the practitioner to treat in both directions without turning the instrument around, this double edge is actually a triple curved radius, similarly to a spherically blunted tangent ogive with a rounded edge profile can help pinpoint the treatment to the damaged area, improving the treatment, as well as making it more comfortable for the patient being treated.

The instrument has four distinct treatment edges which correspond to different contours of the body, it has one large convex treatment edge and one large concave treatment edge opposite the large convex edge, one medium convex treatment edge and one small convex treatment edge opposite the medium convex edge; the large concave treatment edge is designed to treat large tissues like the hamstrings, quads and torso, while the large convex treatment edge opposite the convex treatment edge treats the same tissues but more aggressively, the convex treatment edge pinpoints its treatment in a smaller area within the large tissue, the medium convex treatment edge is designed to treat small to medium tissues and medium to large joints like hands, feet, lower legs, ankles, knees, shoulders, elbows and wrists, the small convex treatment edge is designed to treat smaller tissues and those harder to get to areas like parts of the hands, fingers, the carpal tunnel and the supraspinatus tendon.

The instrument is made from a hard non-porous malleable material, this allows it to be sterilized, so not to transfer organisms from patient to patient, it has two roughened surfaces for gripping the instrument; when an emollient is applied to the skin of the patient, this lubricant is then transferred to the instrument upon treatment; once the tool is turned around to use an alternate treatment edge, it would be difficult to hold the instrument due to the now slippery surface, the roughened surface creates a surface that is easily gripped by the practitioner which minimizes fatigue of the practitioners hands, it has a double radius sharpness angle treatment edge varying from a very small angle leaving the full thickness of the tool up to an average of 50 degrees, but reaching 90 degrees just where it reaches the tip edge radius; this treatment edge is all the way around the instrument with a very small tip edge radius.

Objects & Advantages

The treatment edge of the instrument starts at the full thickness of the tool with an angle of sharpness 0-1 degrees with an average of around 50 degrees for the 2 radius coming from each side of the tool, and finally reaching over 90 degrees where those radius reach the tip radius edge of the tool; this is where this new tool differs greatly from prior art and existing tools on the market. This continuous change of sharpness angle on the edge profile is where the instrument progressively increases its force on the tissues to be displaced until the sharper angle provides the extra force to break down the adhesions and restore the normal elasticity of the tissue.

The $ST^2$ is designed for use by a practitioner for soft tissue mobilization and myofascial release. The instrument is used by applying pressure with the double beveled treatment edge, FIG. 3 numbers 2 and 3 to the skin, particularly a human. An emollient is applied to the surface of the skin in order to slide the instrument along the surface. This sliding of the instrument is in all directions along the surface of the skin with a purpose of breaking up fibrous adhesions between the fascial layer and either the muscular, tendonous or ligamentous layer. Fascia surrounds every muscle, ligament and tendon throughout the human body. Fibrous adhesions develop between the layers due to either acute trauma, a repetitive motion disorder or chronic inflammation. These adhesions cause chronic pain and decreased range of motion. Because of the instrument's thickness and hard material, the practitioner can feel where the adhesions or trigger points are located. It feels gritty underneath the instrument where there are fascial adhesions. This would not be as evident with the use of the practitioners hand The vibrations produced are being amplified through the instrument.

The $ST^2$ is used to break up these fibrous adhesions. In the process of treatment, it also causes a controlled inflammation, which brings in blood flow and rinses away the fibrous adhesions the practitioner just broke up while providing nutrients for healing.

The $ST^2$ is also used for trigger point therapy, as well as scar tissue removal and reorganization. It's treatment edges ultimately break up the taut bands that make up a trigger point. It also causes a controlled inflammation, which brings in nutrients, mainly ATP allowing for the release of the actin heads from the myosin filaments. This causes the taut bands to release, thus elimination of the trigger point. The $ST^2$ helps break up scar tissue formation by the same method as breaking up fibrous adhesions. This is needed in cases where a patient is injured and tears a ligament or tendon. This tear is healed with scar formation. The problem is the scar tissue is laid down in an unorganized fashion, which restricts its full strength, range of motion and functionality. The $ST^2$ instrument can help break up some of the scar tissue. Immediately after treatment, the patient will stretch the ligament or tendon in order for the tissue to regain its original range of motion. This process is repeated until the tissue is fully healed and range of motion has been restored.

The soft tissue tech has 4 treatment edges specifically contoured for the multitude of body contours. The double beveled treatment edge allows the practitioner to treat in all different directions without having to turn the instrument around. This allows for more fluid movements in comparison to a single bevel. The large concave treatment edge is for working less aggressively with medium to large tissues like legs, arms, hips, chest and back. The large convex treatment edge is for working more aggressively with medium to large tissues like legs, arms, hips, chest and back, seeing as it is opposite the surface being treated. The medium convex treatment edge is for working with small to medium tissues and medium to large joints like knees, shoulders, elbows, ankles, wrists, ankles, hands and feet. The small convex treatment edge is for working with smaller tissues and those harder to get to areas like the supraspinatus tendon, carpal tunnel, hands and feet.

The treatment edge, which is a spherically blunted tangent ogive, pinpoints the treatment even further than just one radius with a flat bevel; furthermore, this treatment edge progressively breaks down scar tissue and fibrous adhesions more effectively and comfortably for the patient. There is an evident correlation between several science fields such that fibrous adhesions, trigger points and traumatized tissues react to therapeutic treatment following similar principles such as fluid motion, hydrodynamic and granular particle displacement, this is why the new therapeutic instrument is formed with a specific edge profile. Reference; "Nose Cone Design" by www.wikipedia.org, and "The Descriptive Geometry of Nose Cones" by Gary A. Crowell Sr.

BRIEF DESCRIPTION OF THE DRAWINGS

This invention's objects, features and advantages will be better understood in consideration of the detailed description of several embodiments illustrated in the drawings, in which.

LIST OF REFERENCE NUMERICALS

Figure 1:
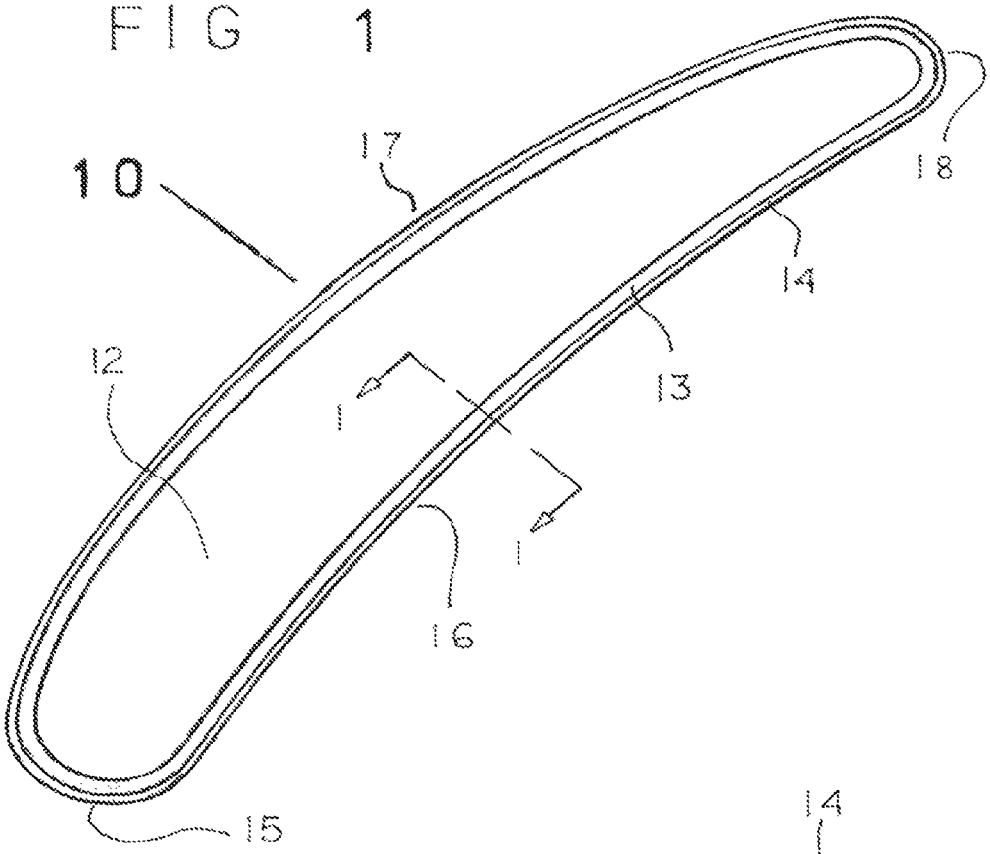
FIG. 1 is a top view of the first embodiment of the ST2 Instrument.

10 elongated ST2 tool.
12 textured surface
13 large radius bevel
14 rounded edge
15 large radius end
16 large concave edge
17 large convex edge
18 small radius end
20 compact ST2 tool
22 textured surface
23 large radius bevel
24 rounded edge
25 large radius end
26 concave edge
27 convex edge
28 small radius end
29 straight edge section

DETAILED DESCRIPTION OF THE INVENTION

The description of the ST2 tools is related to the shape of two soft tissue tech therapeutic tools or instrument, an elongated and a compact one as a combination set.

Figure 2:
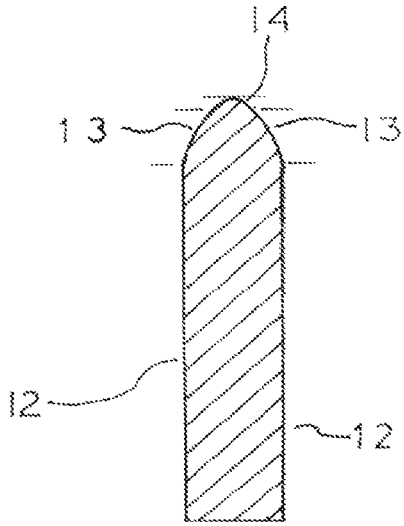
FIG. 2 is a sectional view of FIG. 1 following line 1-1.

FIGS. 1 and 2 are top and sectional views of an ST2 tool illustrating a curved elongate instrument of dimensions of around 9 inches long by 1.5 inches wide with a generally uniform body thickness of around 0.2 inches; the tool has a textured finish 12 on both sides for a graspable surface; this surface is followed by a large radius (around ¼" radius) double bevel 13 with a rounded edge tip 14 of around 0.030 inch of radius; the tool's outer shape includes a wide concave treatment edge 14, a long convex treatment edge 17 linked by a medium radius treatment end edge portion 15 and a smaller radius treatment end edge portion 18.

The FIG. 2 cross-sectional view illustrates how the triple radius bevel edge profile is shaped in the form of a tangent ogive ending with a small radius nose, where the radius of the bevel 13 is around or wider than the thickness of the tool body.

Figure 3:
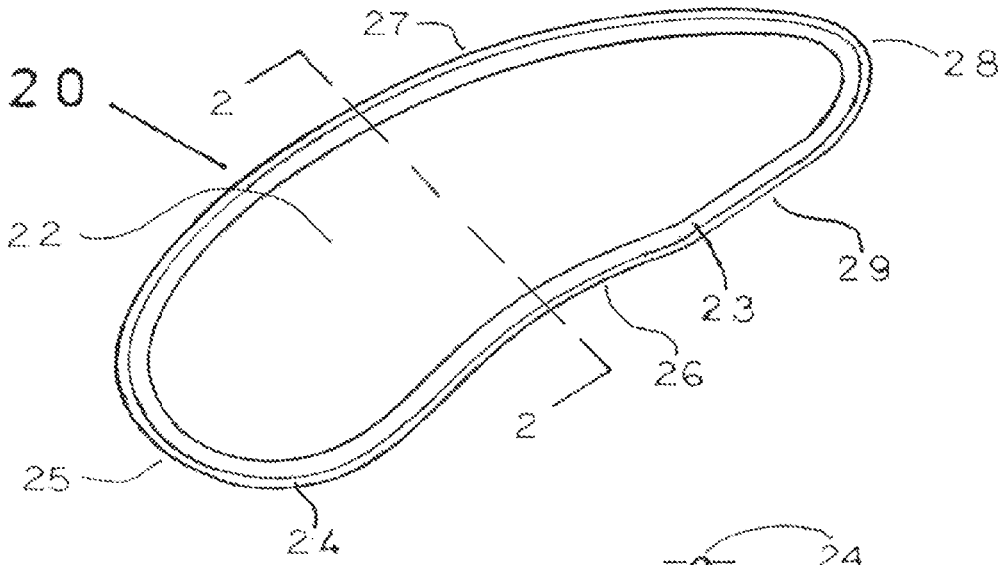
FIG. 3 is a top view of a second embodiment of the ST2 Instrument.
Figure 4:
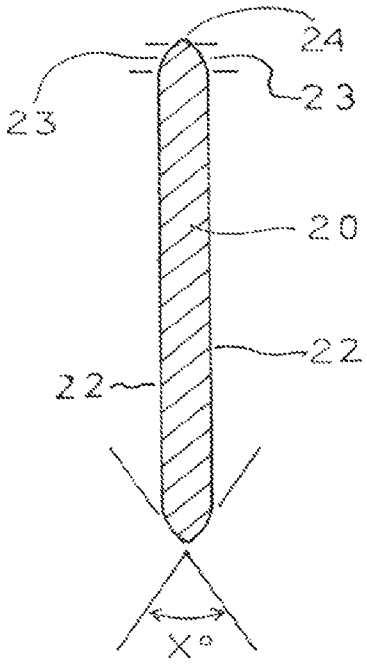
FIG. 4 is a cut-off view of FIG. 3 following line 2-2.

FIGS. 3 and 4 illustrate the top and cross-sectional views of the compact ST2 tool, this second embodiment of the instrument is shorter but wider than the first embodiment with length of around 6.5 inches, width of around 2.5 inches and similar thickness.

In FIG. 3 instrument 20 is illustrated by as having textured top and bottom surfaces these surfaces being followed by a large radius (around ¼ inch) double radius bevel surface 23 with a joining rounded tip edge 24 of around 0.030 inch of radius; the tool's outer shape includes a large radius treatment edge 25 followed on each side by a concave treatment edge 26 and a wide convex treatment edge 27, the second treatment end portion of shorter radius 28 is followed by a straight section 29 of treatment edge of around 1.5 inches in length.

FIG. 4 illustrates the cross-sectional view of the instrument 20 with its double textured surface 22 and each treatment edge has a triple radius bevel 23-24-23 which forms an approximate angle of X degrees of around 50 degrees of sharpness.

It is to be noted that the sharpness angle of the tool triple radius bevel edge varies progressively from 0-1 degrees when leaving the full thickness of the tool body 10 or 20 reaching up to 90 degrees just before the small radius tip edge 24, therefore the average sharpness is taken by the straight line starting at the start of the ogive radius and going to the start of the small radius forming the tip of the edge; this average generally falls between 45 and 60 degrees.

The fabrication of the ST2 instrument follows the same process of a similar part done with the same material, as an example, the first choice would be stainless steel which would start as a steel plate or bar of the right thickness in a low or medium state of hardness;

machining of the specific radius and smaller tip radius can be done with a specialized, double radius end mill done on each side of the plate which had been cut first at the desired shape; the machining of the specific radius and smaller tip radius can also be done by a punch press with two dyes to cut the treatment edge.

A more elaborate process would be to cut both sides at the same time with a cutter having the triple radius profile of the edge.

Another process could be powder metallurgy forming where high density up to 99.7 percent can be achieved including a sintered high quality finish.

The non-slip surface is easily achieved through sand blasting the graspable surface while the edge is protected with an appropriate tape.

Although the said invention is meant for use on human tissue, that is not to say it cannot be used to treat animals; it can be used on any muscle, tendon, ligament or fascial lining of any mammal; in addition, the invention is meant for use by a qualified practitioner, but may be used by a patient for in-home use with the proper instruction; the many advantages which are inherent to the embodiment structure are obvious to the one skilled in the art. Those embodiments are described herein illustratively and are not meant to limit the scope of the invention, therefore variations of the basic embodiment are intended to be encompassed by the following claims.

The invention claimed is:

1. A soft tissue therapeutic tool comprising:

a. a graspable rigid elongated tool body having a treatment edge extending around the entire periphery thereof providing a curved long positive treatment edge portion opposite to a curved negative treatment edge portion joined at each end by two end treatment edge portions of smaller curvature radius;

b. the tool body being in the form of a substantially planar plate member having a substantially uniform thickness of substantially 0.2 inch with graspable first and second flat surfaces each having a textured finish adapted to provide a grip surface for the hand;

c. the treatment edge extending from the first flat surface to the second flat surface and having a tapered edge profile extending around the periphery of each of the first and second flat surfaces, the edge profile being a tangent ogive including curved bevels of a predetermined positive radius each extending from a respective one of said first and second flat surfaces of the tool body and with the two curved bevels being joined at a tip edge by an arcuate tip portion with a radius of substantially 1/50 inch; and d. the tool body being formed out of a material selected from a metal, an alloy material, and a composite that has suitable qualities of finish, hardness, sanitariness, and resonance.

2. The soft tissue therapeutic tool of claim 1 wherein the dimension of the predetermined positive radius of said edge profile is substantially 0.3 inch.

3. The soft tissue therapeutic tool of claim 2 wherein the edge profile has a sharpness angle of substantially 50 degrees.

4. The soft tissue therapeutic tool of claim 3 wherein the arcuate tip portion forms a segment of circle of substantially 80 degrees.

5. The soft tissue therapeutic tool of claim 1, wherein the predetermined positive radius is around 1.5 times the thickness of the tool body.

6. The soft tissue therapeutic tool of claim 4 where the tool length and width are substantially 9 inches and 1.5 inches respectively, and the two end treatment edge portions of the tool each have a different radius.

7. The soft tissue therapeutic tool of claim 4 wherein the tapered edge profile is configured so as to provide a superior treatment effectiveness of soft tissue structures because the edge profile is adapted to displace the tissue in a more physiological correct manner.

8. The soft tissue therapeutic tool of claim 1 wherein the preferred material is stainless steel.

9. A soft tissue therapeutic tool comprising:

a. a graspable rigid elongated tool body and a continuous treatment edge portion extending around the entire periphery of the tool body substantially in one plane and said continuous treatment edge portion having a curved positive treatment edge portion opposite to a curved negative treatment edge portion and joined to each other by two shorter-radius curved end treatment edge portions;

b. the tool body having a substantially uniform thickness of 0.2 inches with first and second substantially planar graspable surfaces, each having a textured finish adapted to provide a suitable grip for the hand;

c. the tool body treatment edge having a tapered edge profile at the tool body's periphery and extending from said first graspable surface to the second graspable surface, said tapered edge profile including curved bevels of a predetermined positive radius each extending from a respective one of said first and second graspable surfaces, and the two curved bevels being joined at a tip edge thereof by an arcuate tip portion with a radius of substantially 1/32 inch; and d. said tool body being formed out of a material selected from a metal, an alloy material, or a composite that has suitable qualities of finish, hardness, sanitary, and resonance.

10. The soft tissue therapeutic tool of claim 9 wherein the said one specific predetermined positive radius is substantially 0.25 inch.

11. The soft tissue therapeutic tool of claim 10 wherein the said tool body has a general shape similar to a kidney bean with a larger radius at one end and a smaller radius at the other end.

12. The soft tissue therapeutic tool of claim 11 wherein said edge profile has a double radius edge profile with a sharpness angle of substantially 50 degrees.

13. The soft tissue therapeutic tool of claim 12 wherein the arcuate tip portion is in the form of a segment of circle of substantially 80 degrees.

14. The soft tissue therapeutic tool of claim 9, wherein the predetermined positive radius is substantially 1.5 times the thickness of the tool body.

15. The soft tissue therapeutic tool of claim 13 where the tool body has a length and a width of substantially 6 inches and 2 inches, respectively, and two ends of the tool are each of different radius; with one curved negative treatment edge at a junction to the smaller radius end providing a straight treatment edge of substantially 1.5 inches while maintaining the respective shapes of the concave treatment edge and the smaller-radius end.

16. The soft tissue therapeutic tool of claim 14 wherein the edge profile is adapted to provide superior treatment effectiveness in that the edge profile displaces the tissue in a more physiologically correct manner.

17. The soft tissue therapeutic tool of claim 9 wherein the preferred material is stainless steel.

18. A soft tissue therapeutic tool comprising:

a. a graspable rigid mini tool having one curved positive treatment edge portion opposite to a curved negative treatment edge portion joined to each other by two shorter-radius curved end treatment edge portions;

b. the mini tool having a predetermined substantially uniform thickness body in the form of a planar plate member, of substantially ⅛ inch thickness and having first and second substantially planar graspable surfaces on opposite flat sides of said body and which each are texture-finished and adapted to provide a satisfactory grip for the hand, the body being bounded around the periphery of said first and second planar surfaces by said treatment edge portions;

c. the mini tool treatment edge portions each having a tapered edge profile formed of first and second opposed bevels of a predetermined positive radius and each extending from a respective edge of one of the first and second graspable surfaces of the mini tool, the opposed bevels being joined at an arcuate tip edge, the latter having a radius of substantially 0.02 inch; and d. the tool being formed out of a material selected from metal, an alloy material, or a composite that has suitable qualities of finish, hardness, sanitariness, and resonance.

19. The soft tissue therapeutic tool of claim 18 wherein the general shape of the mini tool is similar to an oblong rectangular kidney bean with a wide convex side, having said positive treatment edge portion thereon, opposite to a wide concave side, having said negative treatment edge portion thereon, and being joined to one another by said end treatment edge portions, for a total dimension of substantially 4 inches by 2.5 inches.

20. The soft tissue therapeutic tool of claim 18 wherein the preferred material is stainless steel.

* * * * *